US010590582B2

(12) United States Patent
Scatizzi

(10) Patent No.: US 10,590,582 B2
(45) Date of Patent: Mar. 17, 2020

(54) DYEING UNIT

(71) Applicant: TECNORAMA S.R.L., Prato (IT)

(72) Inventor: Mario Scatizzi, Pistoia (IT)

(73) Assignee: TECNORAMA S.R.L., Prato (IT)

( * ) Notice: Subject to any disclaimer, the term of this patent is extended or adjusted under 35 U.S.C. 154(b) by 238 days.

(21) Appl. No.: 15/545,802

(22) PCT Filed: Nov. 4, 2015

(86) PCT No.: PCT/IT2015/000268

§ 371 (c)(1),
(2) Date: Jul. 24, 2017

(87) PCT Pub. No.: WO2016/120895

PCT Pub. Date: Aug. 4, 2016

(65) Prior Publication Data

US 2017/0370041 A1 Dec. 28, 2017

(30) Foreign Application Priority Data

Jan. 26, 2015 (IT) ..... FI15A0012

(51) Int. Cl.
*D06B 23/10* (2006.01)

(52) U.S. Cl.
CPC ..... *D06B 23/10* (2013.01)

(58) Field of Classification Search
CPC ..... D06B 23/10
See application file for complete search history.

(56) References Cited

U.S. PATENT DOCUMENTS

2002/0144524 A1 10/2002 Hsu
2010/0018260 A1* 1/2010 Rapoport ..... D06B 23/10 68/200

FOREIGN PATENT DOCUMENTS

| | | | |
|---|---|---|---|
| DE | 513285 | C | 11/1930 |
| DE | 38 11 060 | A1 | 7/1989 |
| EP | 1174535 | A2 | 1/2002 |
| GB | 1 268 159 | A | 3/1972 |

* cited by examiner

*Primary Examiner* — Spencer E Bell
(74) *Attorney, Agent, or Firm* — McGlew and Tuttle, P.C.

(57) ABSTRACT

Dyeing unit, adapted to test and/or monitor the effects of dye baths on textile materials, comprising a body (7) with tanks (8) with openable and closable lids (9), and each adapted to contain a dyeing bath and a textile sample, means (MM) adapted to move said body (7) for stirring the dyeing bath contained in the tanks (8), and means for the discharge of said dyeing baths from the tanks (8). The tanks (8) are integral to said body (7) and the latter is closed both above and laterally and inferiorly thus defining a closed volume (V7) in which is contained a thermal fluid (FT), so that the tanks (8) are always immersed in the same thermal fluid (FT).

20 Claims, 16 Drawing Sheets

DYEING UNIT

The present invention relates to a dyeing unit, in particular for textile samples which can be used especially in the field of operations called "laboratory" conducted to test and/or control the effects of the dyeing baths on textile materials. For carrying out this procedure were used in the past dyeing machines comprising extractable individual pots allowing the manual preparation of the dyeing bath, and the insertion of the same and the sample to be dyed in said pots before repositioning them in a tank containing an heated medium, which was brought to the desired temperature required by the dyeing program. The closed pots were then subjected to a movement in order to allow an efficient dyeing of the sample.

DE513285C and US2002/144524A1 disclose dyeing units for testing the effects of dyeing baths on textile materials. The operations of manual extraction of the cups, refill with samples, prepare the successive dyes, caused the operator to come into contact with the heated medium and eventual exhalations thereof on the outside of the machine and in the working environment.

As a result of the introduction of restrictive regulations on the use of such thermal mediums, the manufacturers of such labor machines started to use infrared radiant heating means which do not generate similar problems. However also in these machines emerge tests of inconsistency in the behavior of the temperature between the various pots.

The industrial practice has shown that the dyeing systems which make use of a thermal carrier fluid, on the contrary, guarantee a uniform thermal dyeing and results better than the systems based on the use of radiating heating means, this thanks to the direct contact of all the cups with the same thermal carrier fluid during the whole process of dyeing.

The main object of the present invention is thus to propose a dyeing system which allows to overcome the said drawbacks and at the same time to optimize qualitatively the steps of a dyeing process also offering the possibility of automating the whole process.

It is thus proposed a dyeing unit according to claim 1, which is essentially provided with tanks having openable and closable lids, adapted to contain a dyeing liquid and a textile sample, said tanks being integral to a body defining a closed volume in which is contained a thermal fluid, so that the tanks are always immersed in the same fluid, said body being movable, for example with a rotating motion, for stirring the dyeing bath. Other features of the present invention are the subject of the dependent claims.

An advantage offered by the present invention is that it is possible to provide a uniform working temperature on all the cups of dyeing, which are constantly immersed in a thermal carrier fluid, being able to provide also the use of fluids such as the diathermic oils, or fluids having a low thermal inertia, but in any case avoiding the contact of the same fluids with the operators and the possible inhalation of the vapors of the same and the consequent contamination of working environment. It is also possible to monitor the process temperature by directly monitoring only one point of the fluid in which the dyeing cups are immersed. Furthermore, it is possible to make use of programmable systems for heating and cooling the thermal carrier fluid. Besides, during the dyeing process the dyeing bath and the textile samples can be shaken at a variable and controlled shaking rate. In addition, it is possible to associate the dyeing unit with automated means for preparing and dosing the dye baths, with automated means for loading/unloading of the textile samples by making use of removable sample-holder baskets as well as with automated means for unloading the dyeing baths and the washing baths from each dyeing cup and with automated means for supplying water the dyeing cups according to the programmed dyeing recipes. Moreover, a dyeing unit in accordance with the present invention is relatively simple from a structural point of view and also not expensive in relation to the advantages it offers.

These and other advantages and features of this invention will be best understood by anyone skilled in the art thanks to the following description and to the attached drawings, provided by way of example but not to be considered in a limitative sense, wherein:

FIG. 1 is a schematic plan view of an apparatus provided with four dyeing units in accordance with the present invention;

FIGS. 2-8 schematically represent a sequence concerning the positioning of a sample-holder basket into a dyeing cup of a dyeing unit in accordance with the present invention;

Figure 17A:
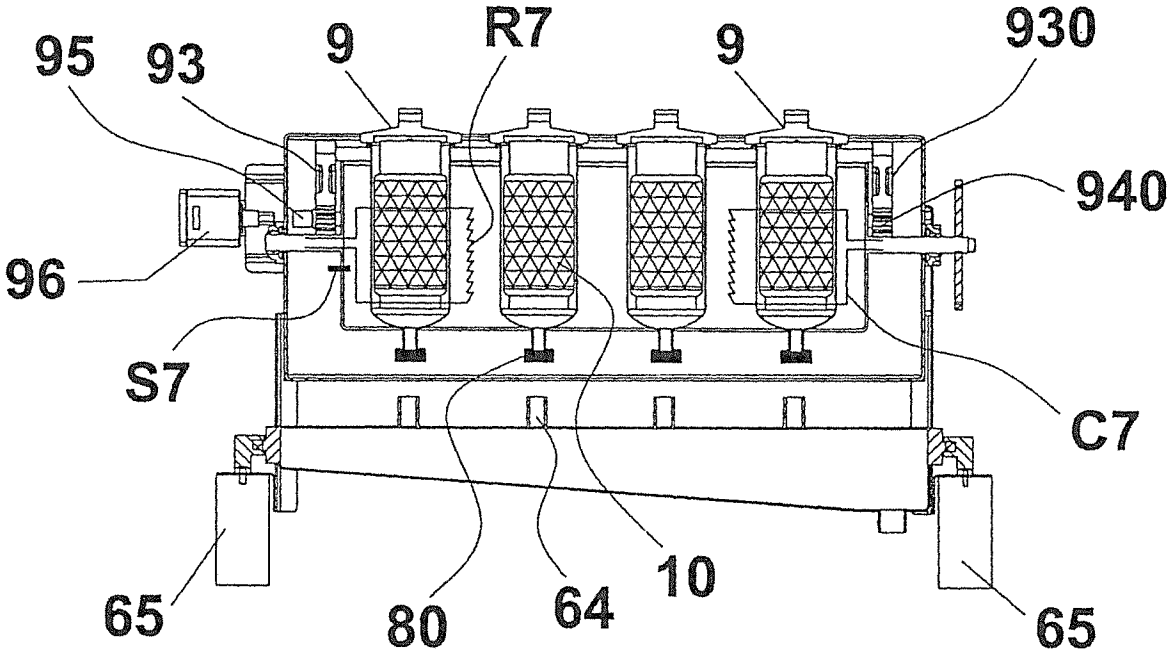
Figure 17B:
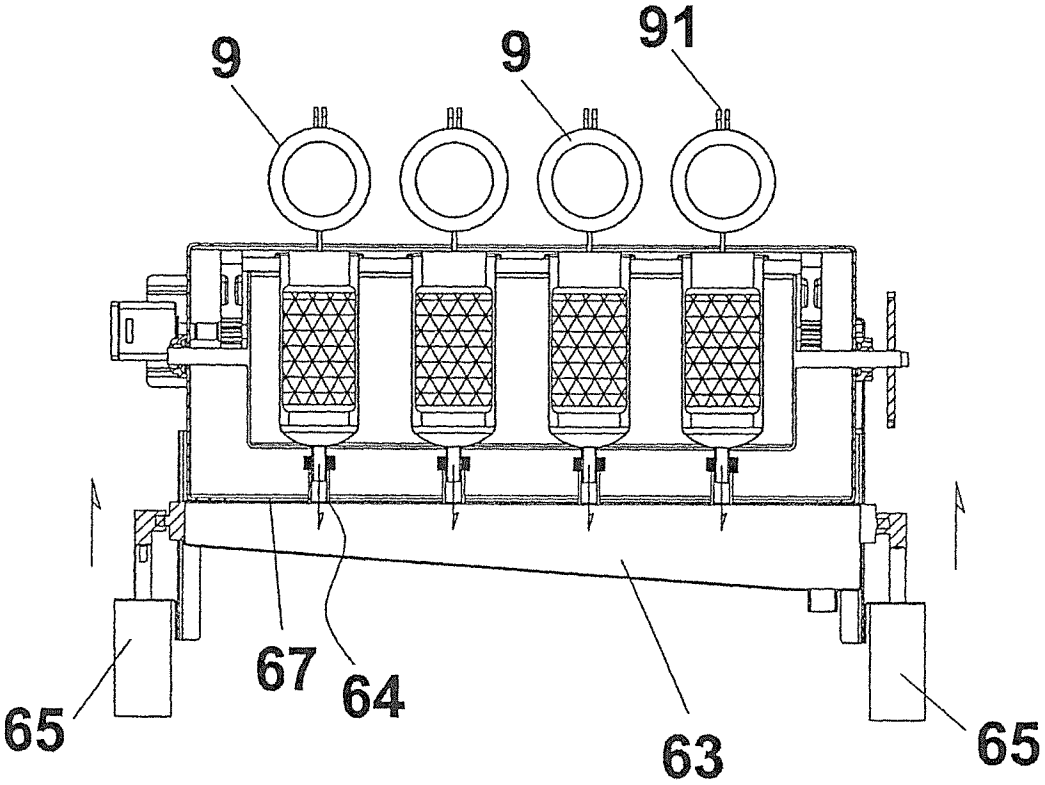
Figure 18:
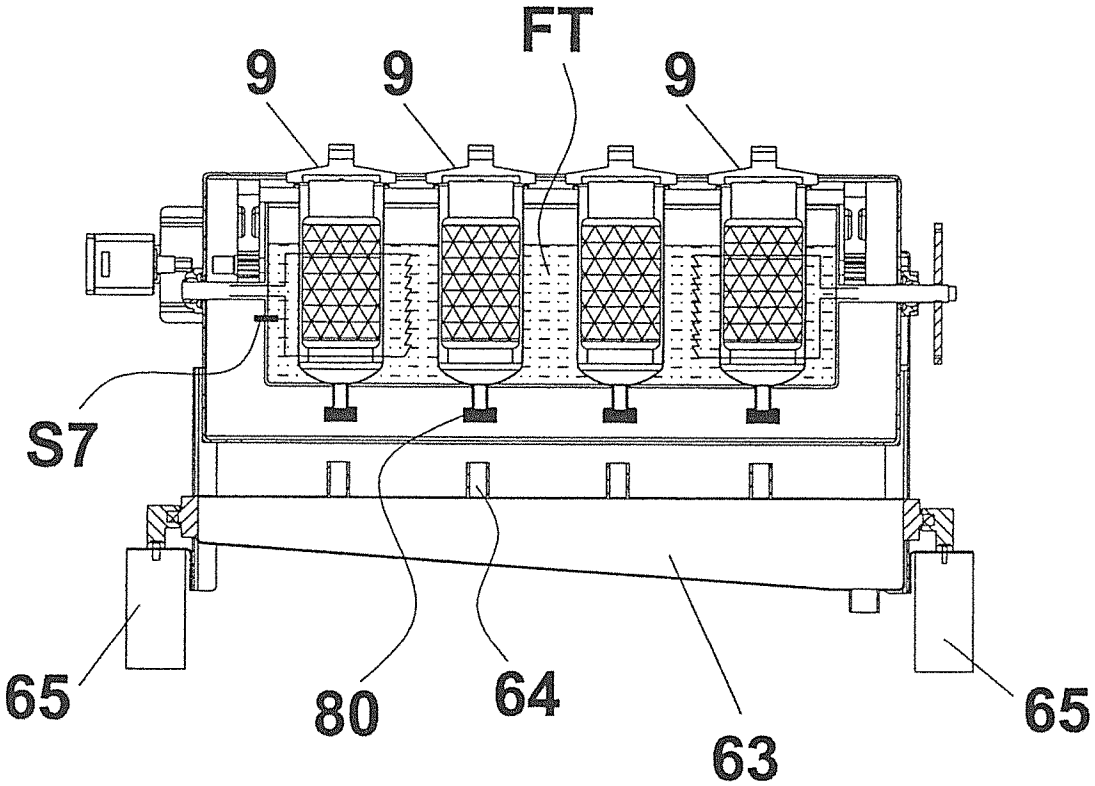

FIGS. 16A-16E schematically show the apparatus of the preceding figures in the stirring phase;

FIGS. 17A and 17B are two schematic longitudinal sectional views of the apparatus shown in the preceding figures in two different operating configurations;

FIG. 18 is similar to FIG. 17A but there is shown the thermal carrier fluid.

Figure 1:
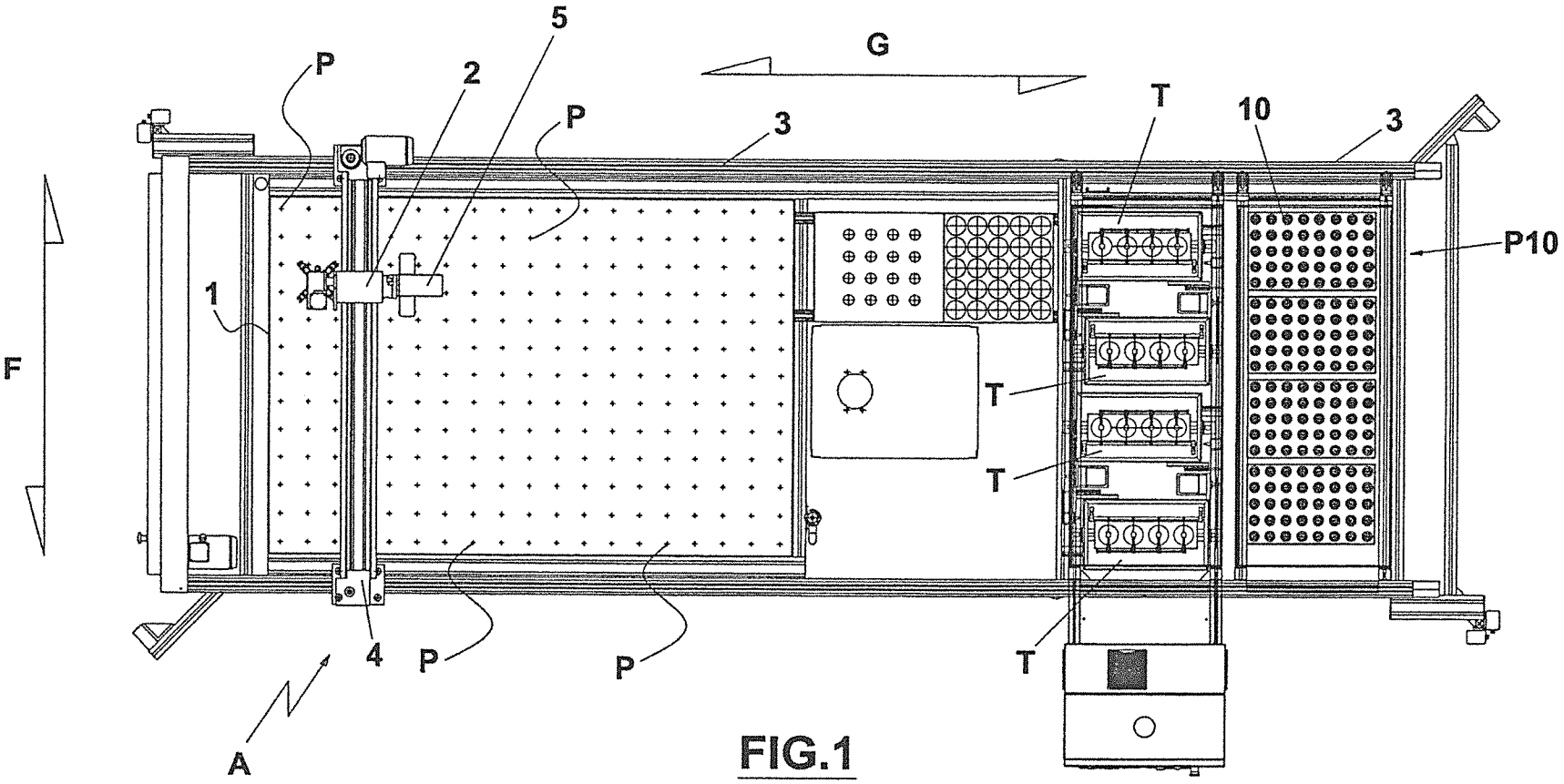

FIG. 1 shows an apparatus (A) for the automated preparation and dosage of dyeing that is described in detail in EP 1174535. Such an apparatus is destined to the production of dyeing baths in so-called "laboratories" of the textile industry, to test the effects of the dyes on the materials to be dyed, and then use them in industrial production. It comprises, in particular, a platform (1) on which can be placed several containers for solid, liquid or powdered chemicals at predetermined positions (P), and a carriage (2). The latter can be moved according to a given working program on the platform (1) and supports robotic means with grippers (5) for picking and handling the containers. The platform (1) is provided with side guides (3) on which moves a cross member (4) that supports the carriage (2). The combined and programmed movements of the carriage (2) over the cross member (4) and of the latter on the guides (3), as schematically indicated by arrows "F" and "G", determines the positioning of the carriage (2) in correspondence with any of the above points (P). The grippers (5) are moved vertically from and towards the platform (1). The process for the preparation of dyeing baths is described in the cited document. According to the example shown in FIG. 1, there are four dyeing units (T) in accordance with the present invention placed on an extension of the platform (1) to exploit the capacity of the apparatus (A) to prepare dyeing baths automatically, i.e. according to programmed dyeing recipes, and also exploit the possibility offered by the carriage (2) to move the grippers (5) also on the extension of the platform (1) thanks to a proper elongation of the side guides (3).

It is understood, however, that each dyeing unit (T) in accordance with the present invention can be located at a position different from that of the apparatus (A) albeit giving up the advantage of combining the dyeing units (T) with the apparatus (A) that produces the dyeing baths used by the same units (T) and the advantage of exploiting the robotic grippers (5).

It is also understood that a dyeing unit (T) in accordance with the present invention can be associated with any other type of equipment for the preparation of dyeing baths.

Moreover, in a dyeing unit (T) in accordance with the present invention the textile samples and the dyeing baths can be loaded and unloaded by manual, instead of automated, operations.

Reduced to its essential structure and with reference to the attached drawings, a dyeing unit (T) in accordance with the present invention comprises:

a fixed box-shaped structure (6);

a box-shaped body (7), adapted to delimit a volume (V7) closed on top, bottom and sides, in which are integrally inserted the dyeing chambers (8) that can be open upwardly and in which body (7) a predetermined amount of a thermal carrier fluid (FT) can be supplied: each of said chambers being a tank defining a dyeing cup (8) provided with a respective lid (9) for closing/opening the upper side thereof and being adapted to contain a removable sample-holder basket (10);

moving means (MM), adapted to rotate said body (7) alternately clockwise and anti-clockwise around a horizontal axis (x-x) to obtain the shaking of the textile samples inserted in each basket (10) and of the dyeing baths in the corresponding dyeing cups (8);

automatic means for handling the baskets (10) from a parking or waiting position (P10) to any one of said dyeing cups (8).

In the configuration of FIG. 1, the parking position (P10) of the baskets (10) is provided on an extension of the platform (1) where are also positioned the dyeing units (T). In this configuration, the means for moving the baskets (10) consist of a gripper unit (5) associated with the carriage (2).

The dyeing cups (8) have their upper part protruding beyond the upper side of the body (7), thus favoring the movement of the lids (9).

In practice, the dyeing cups (8) are an integral part of the body (7) which contains the thermal carrier fluid (FT), that is, the outer walls of the dyeing cups (8) contribute to defining and delimiting said volume (V7) in cooperation with the walls of the body (7).

Figure 2:
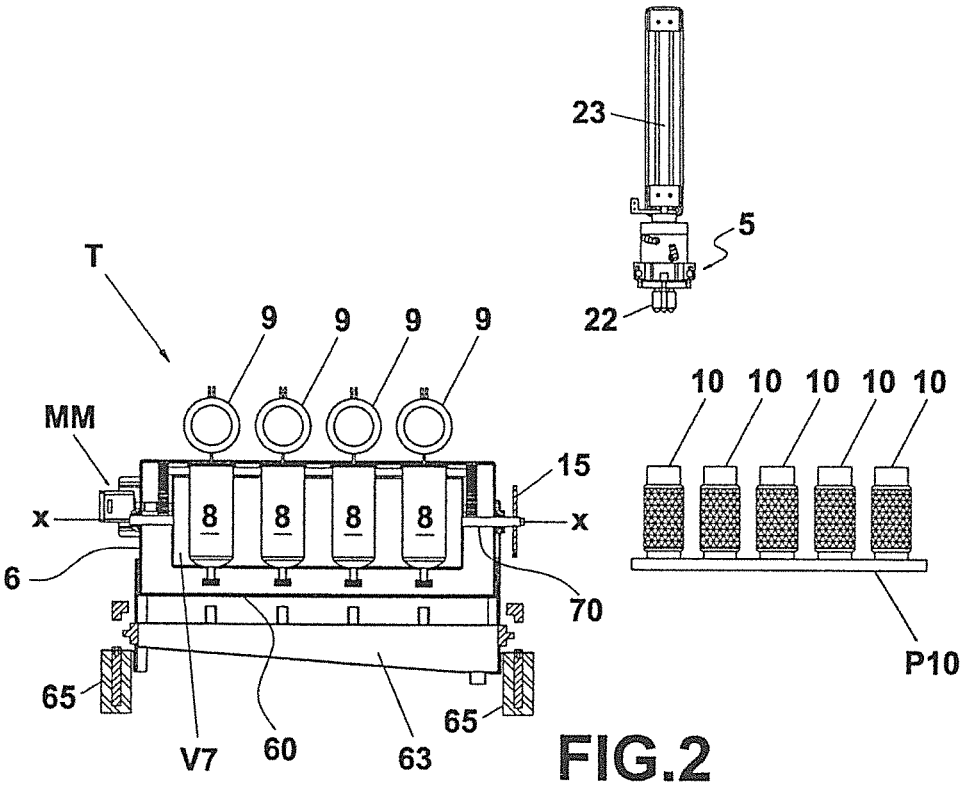
Figure 3:
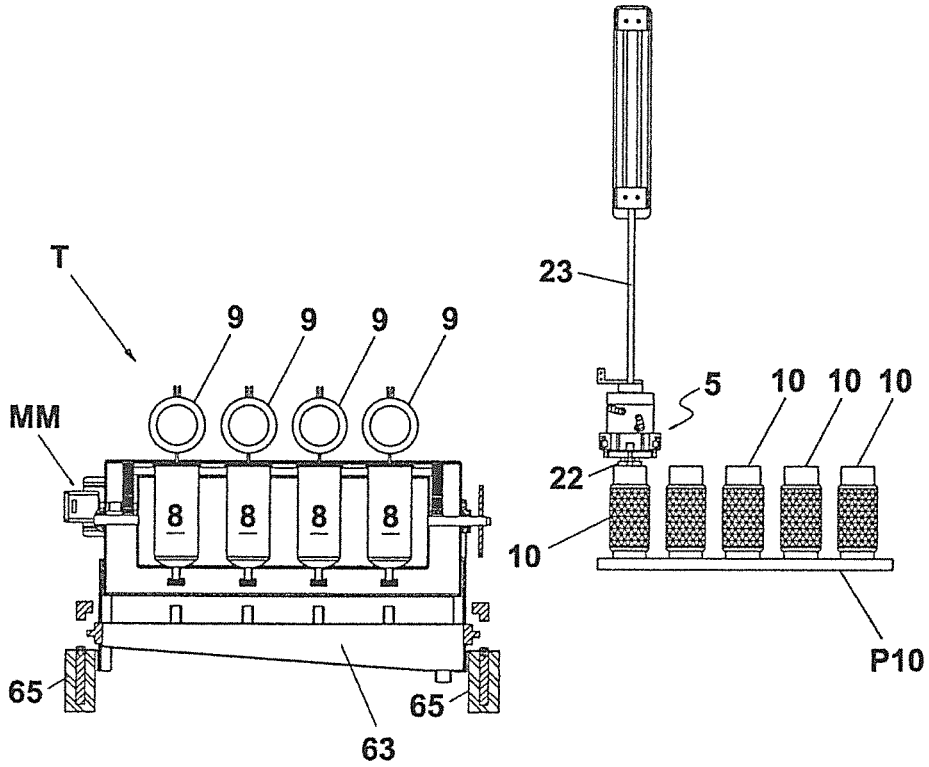
Figure 4:
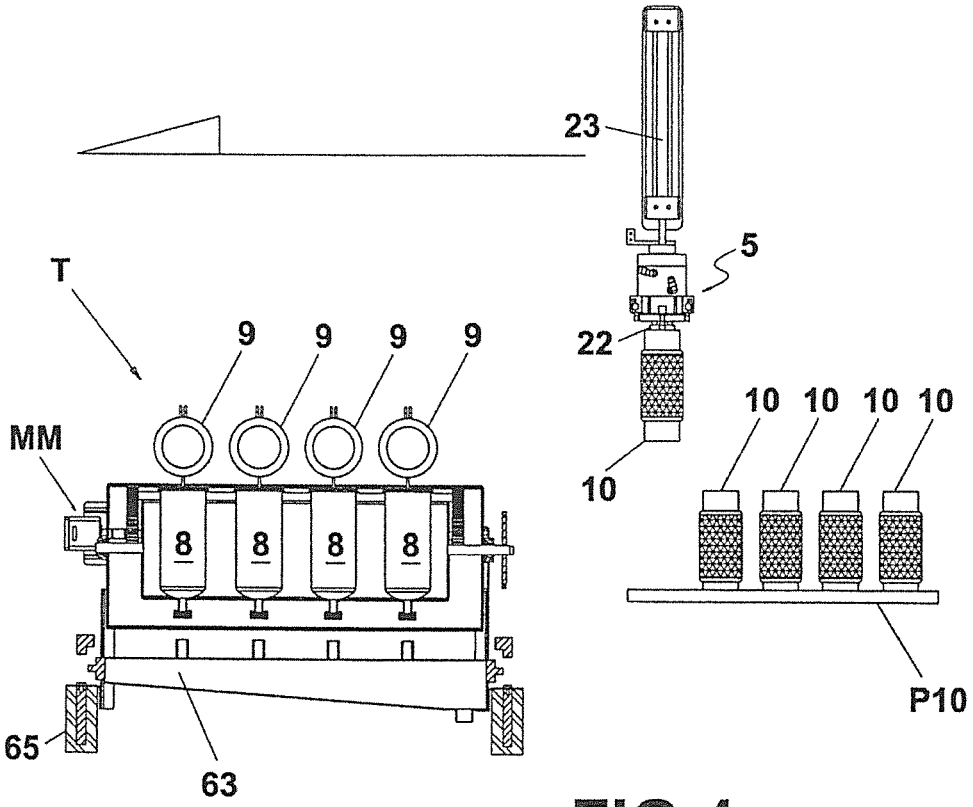
Figure 5:
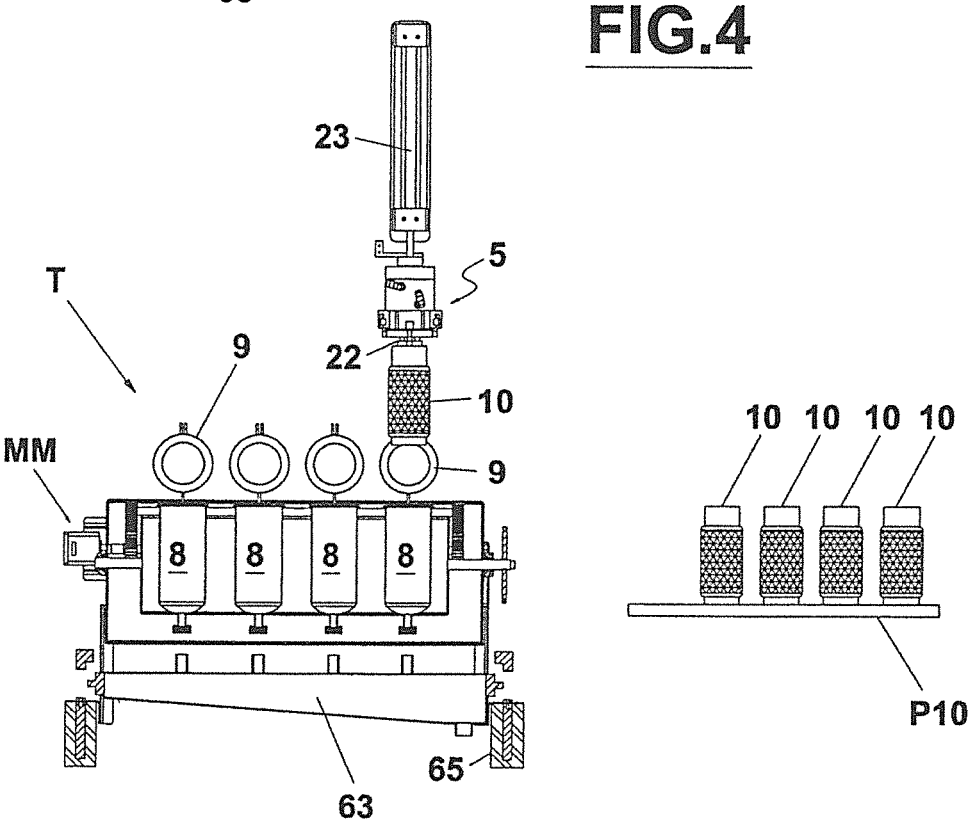
Figure 6:
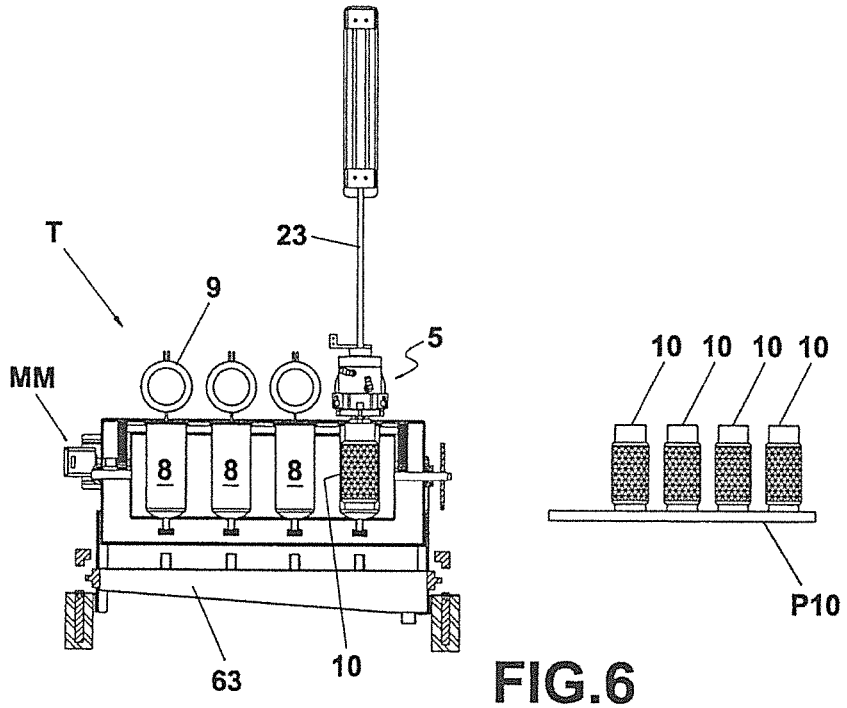
Figure 7:
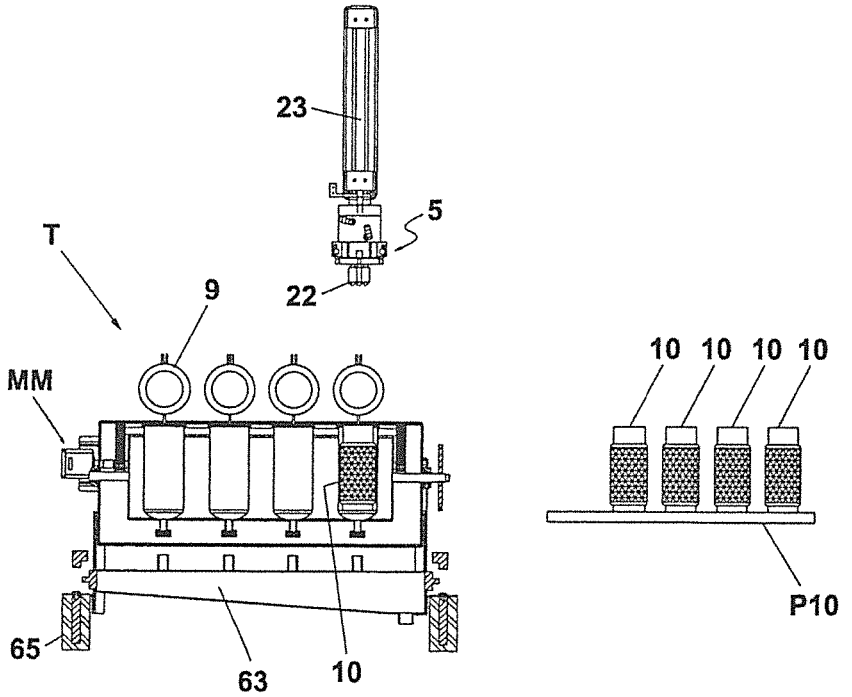
Figure 8:
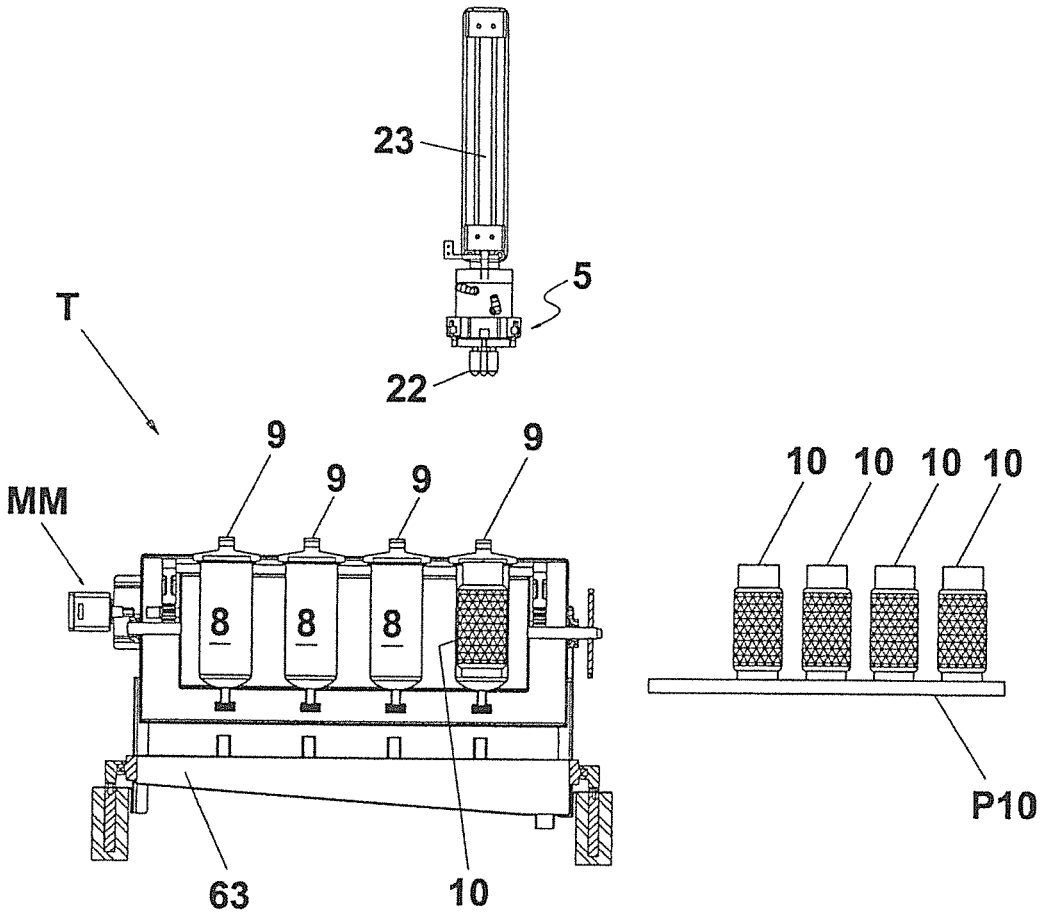
Figure 9A:
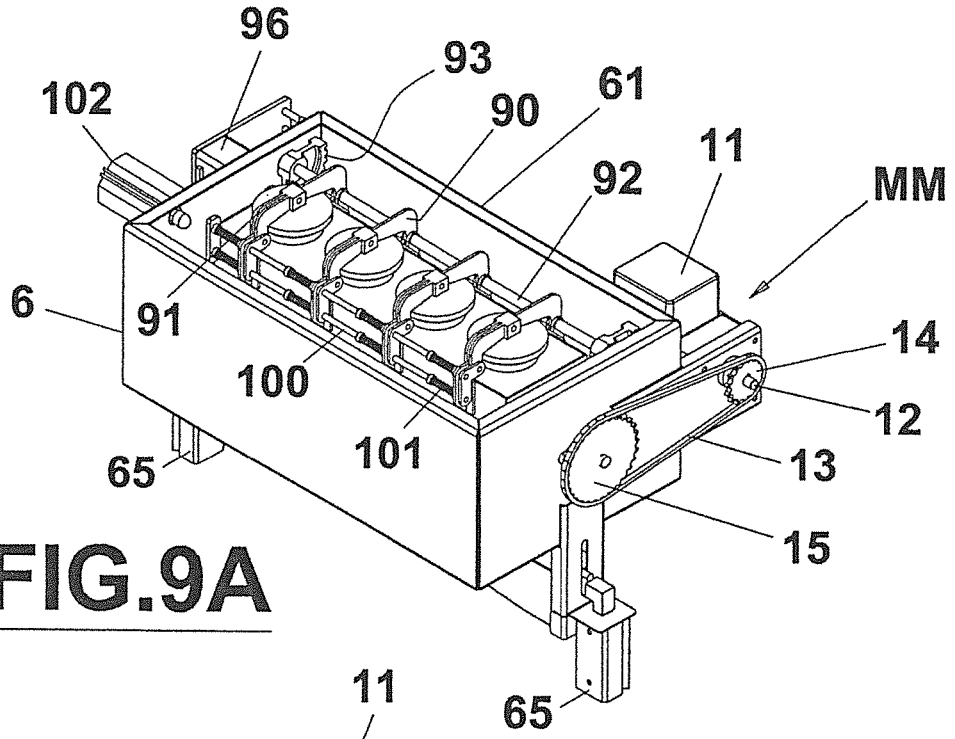
FIGS. 9A and 9B are two perspective views of the machine shown in FIGS. 2-8.
Figure 9B:
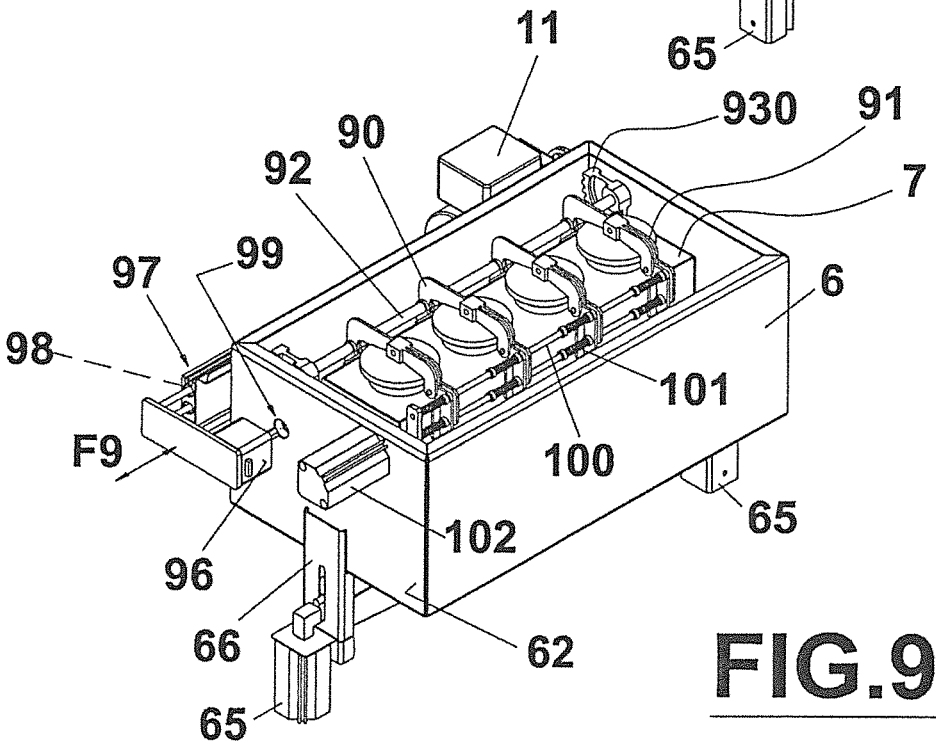

Said moving means (MM) comprise an electric motor (11) fixed on a vertical wall (61) of the fixed structure (6) and whose output shaft (12) is connected, by means of a belt and pulleys transmission (13, 14, 15), with a shaft (70) protruding from the sides of the body (7) and passing through corresponding holes provided in the corresponding flanks of the fixed structure (6). In FIG. 2 the axis of the shaft (70) is the axis (x-x). Said transmission (13, 14, 15) is external to the structure (6). The motor (11) causes the rotation of the body (7) about the axis (x-x) alternately clockwise and counterclockwise. In this way, it is possible to stir the dyeing bath and the materials contained in each basket (10) positioned in a corresponding cup (8) of the body (7). FIGS. 16A-16E show different positions of the body (7) during said rotation starting from an initial position (FIG. 16A) in which the body (7) is positioned such that the dyeing cups (8) are vertically oriented. The gripper (5) associated with the carriage (2) is provided with expandable appendixes or "fingers" (22) that can be inserted in the upper side of the baskets (10) and, as mentioned above, can be moved vertically to and from the platform (1). For this purpose, the gripper (5) is connected to an actuator with vertical axis (23) constrained to the carriage (2).

Each dyeing unit (T) comprises a device for opening, closing and locking the lids (9).

Figure 13:
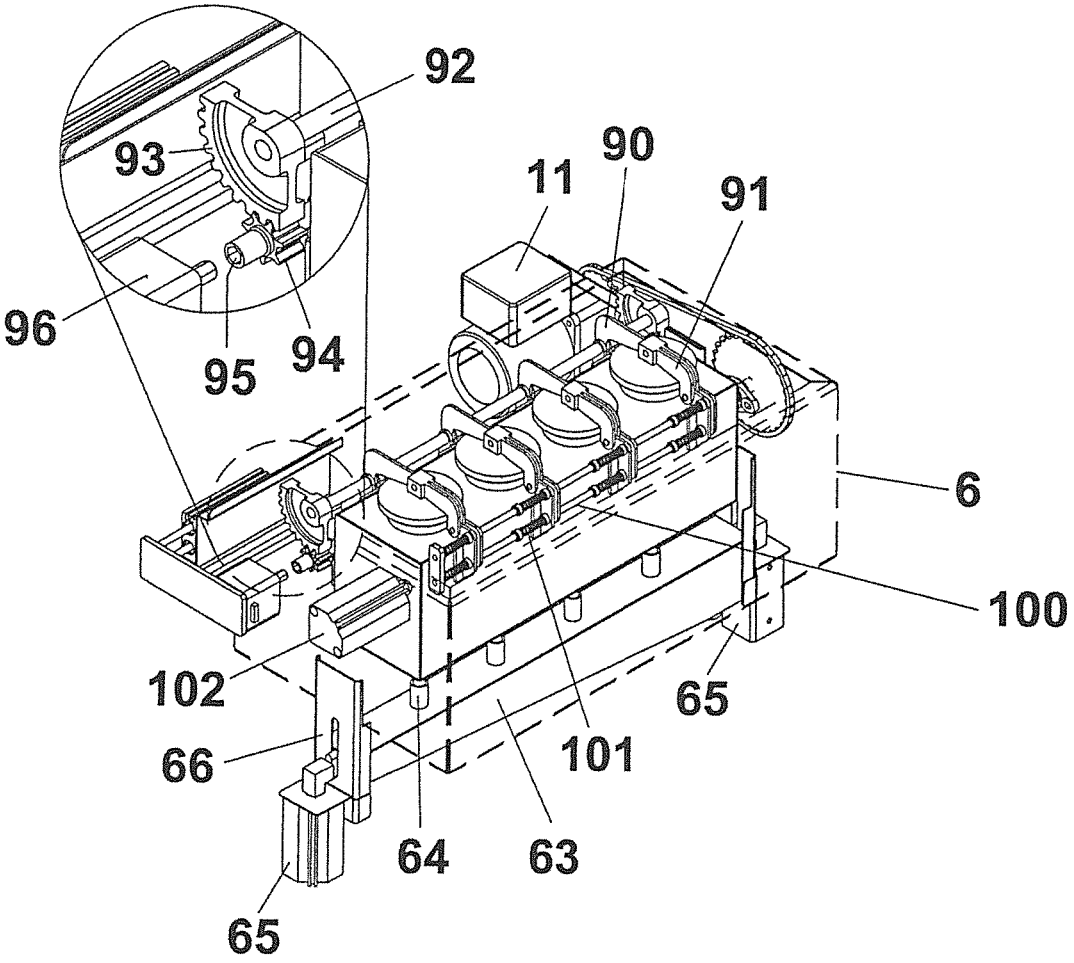
FIGS. 13-15 show, in particular, the means for opening and closing the lids for the dyeing cups.
Figure 14:
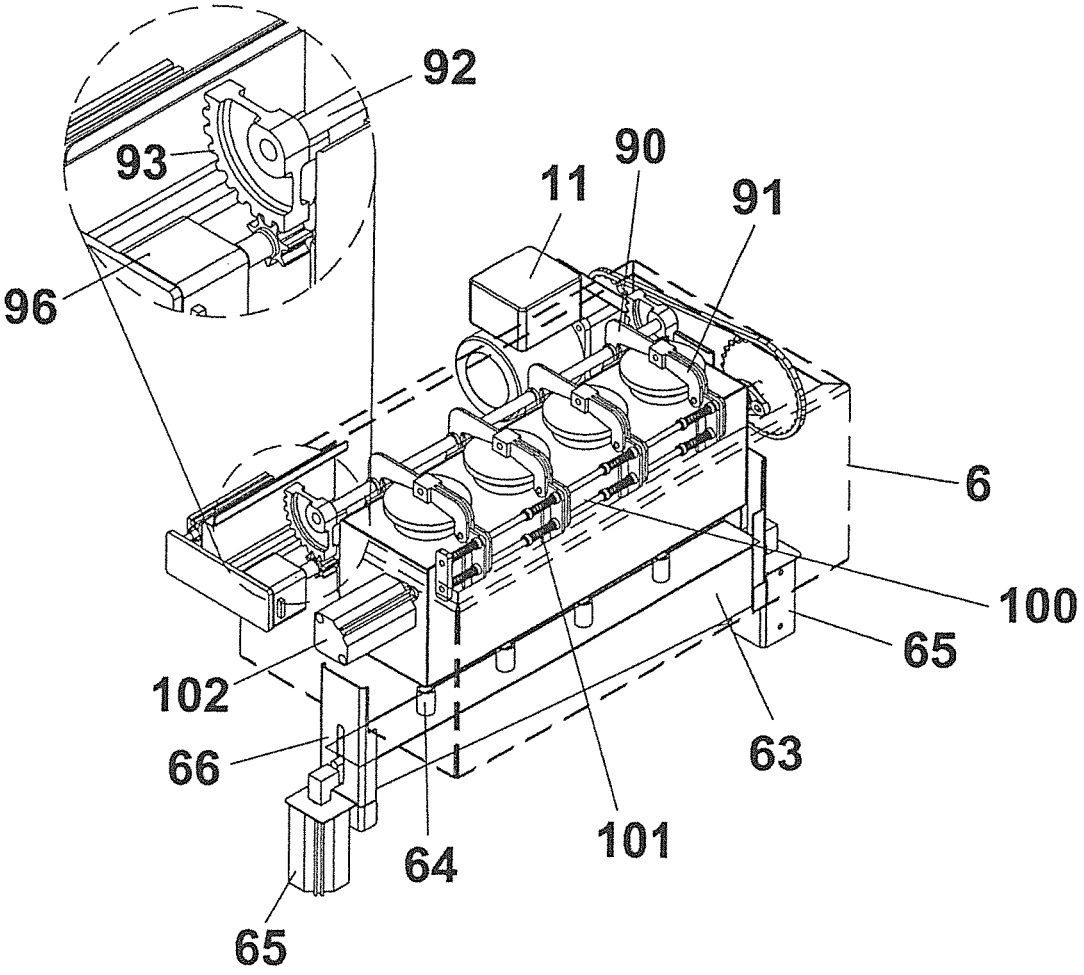
Figure 15:
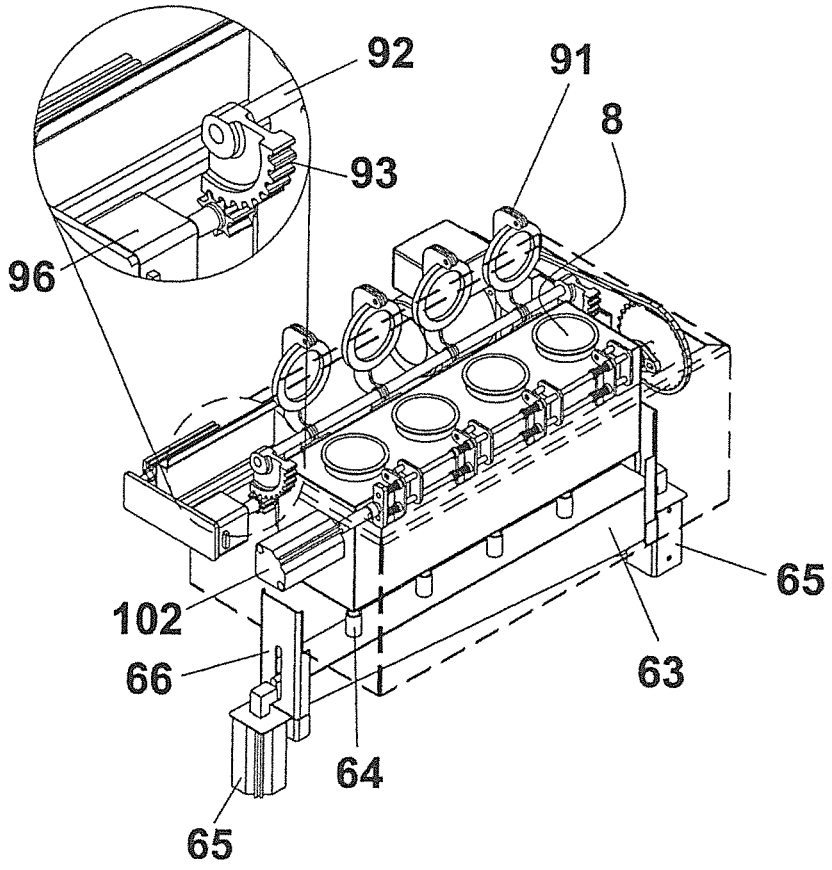
Figure 16D:
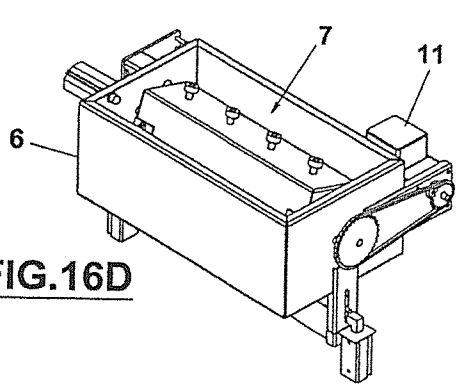
Figure 16E:
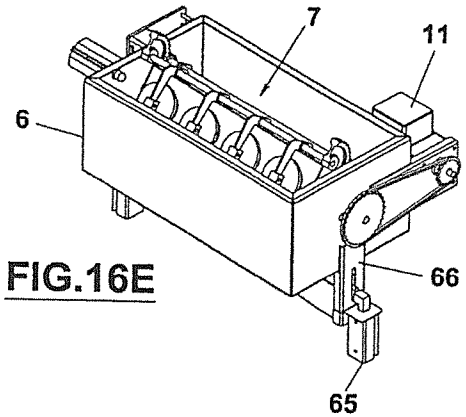
Figure 16A:
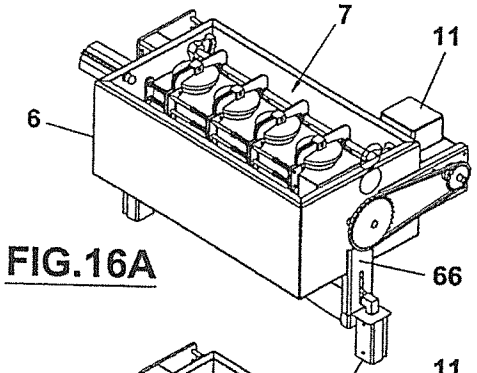
Figure 16B:
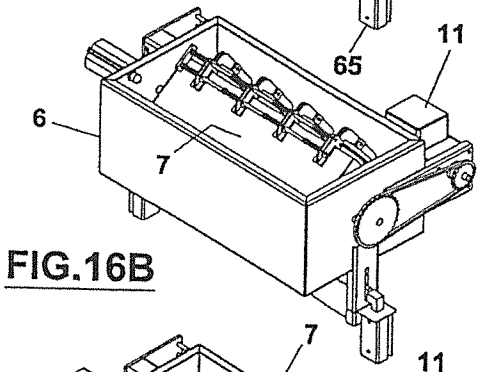
Figure 16C:
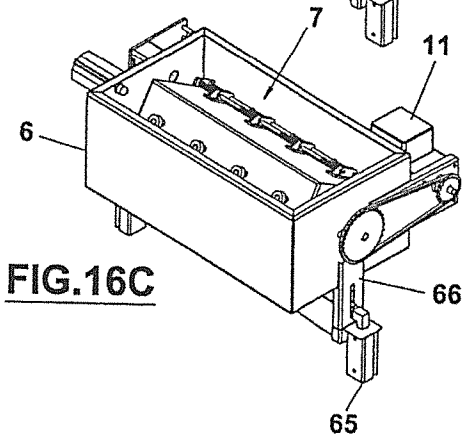

In the proposed example, on top of each lid (9) there are provided two arms (90, 91) which are extensions of each other. An arm (90) is developed along a rear direction relative to the lid (9) while the other (91) develops along a front direction relative to the same lid. The rear arms (90) are keyed on a horizontal shaft (92) positioned externally and parallel to a wall of the body (7) inside the fixed structure (6). On said shaft (92) is applied a toothed sector (93) which meshes with a sprocket (94). The latter is equipped with a central power take-off (95) adapted to be engaged by the output shaft of a corresponding electric motor (96) which, in turn, is mounted on a slide (97) moved by an actuator (98) parallel to the wall (61) of the fixed structure (6) on which is also fixed, on the opposite side, the motor (11) of the stirring unit (MM). The slide (97), the actuator (98) and the motor (96) are external to the fixed structure (6) and the shaft of the motor (96) can engage the PTO (95) of the sprocket (94) passing through a hole (99) provided in a side wall (62) of the structure (6). The sprocket (94) is on the end of a shaft placed at the bottom and parallel to the shaft (92) which, on the opposite side, has a second sprocket (940) meshing with a second toothed sector (930) carried by the (92). The second toothed sector (930) and the second sprocket (940) are shown in FIG. 18. In FIG. 13 the double arrow "F9" represents the movement of the slide (97) and the motor (96). In addition, in FIG. 13 the motor shaft (96) is disengaged, while in FIG. 14 and in FIG. 15 it is inserted in the power takeoff (95), that is, it is in the engaged position. In FIG. 14 the angular position of the sector (93) corresponds to the closed position of the lids (9), while in FIG. 15 the sector (93) is in the opening position of the lids (9). In practice, when the work program provides that the lids (9) are to be opened or closed, the actuator (98) determines the movement (F9) of the motor (96) to engage the shaft thereof in the power take off (95) of the sprocket (94).

Figure 10:
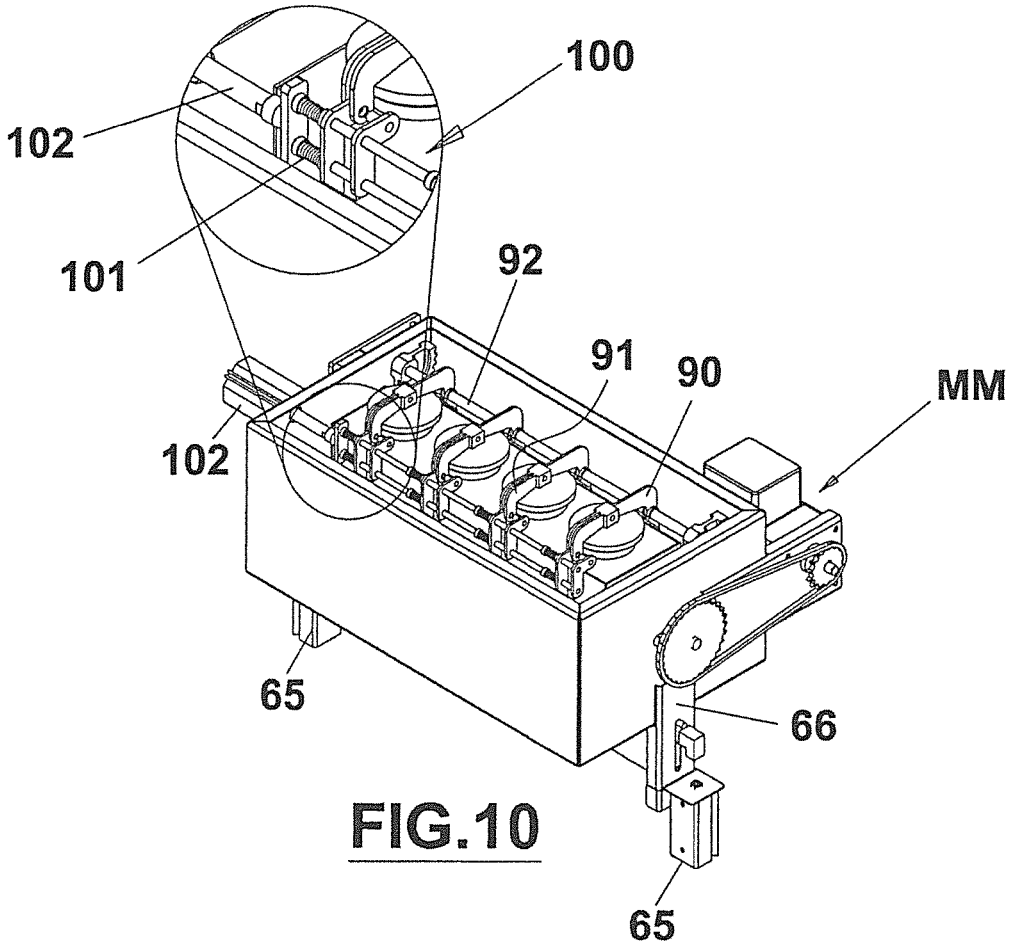
FIGS. 10 and 11 are two perspective views of the machine shown in FIGS. 2-9, in which, in particular, are shown some details of the mechanism for locking and unlocking the lids of the dyeing cups.
Figure 11:
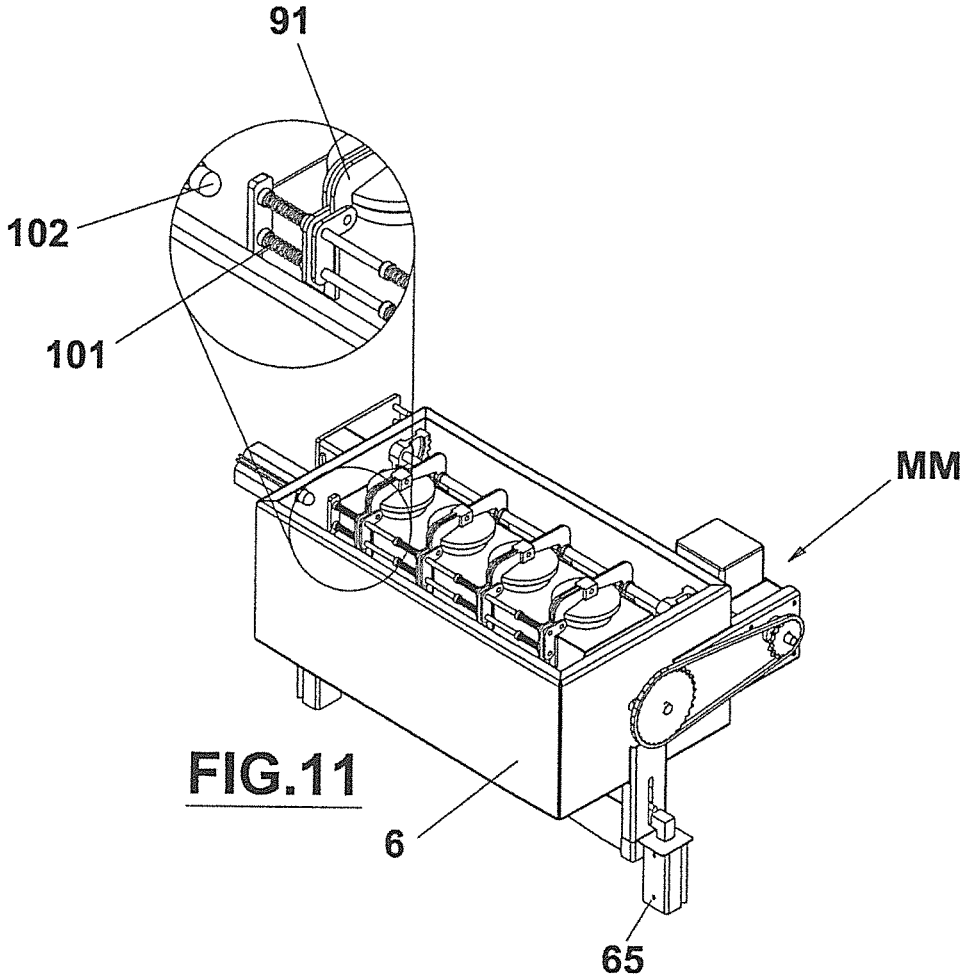
Figure 12:
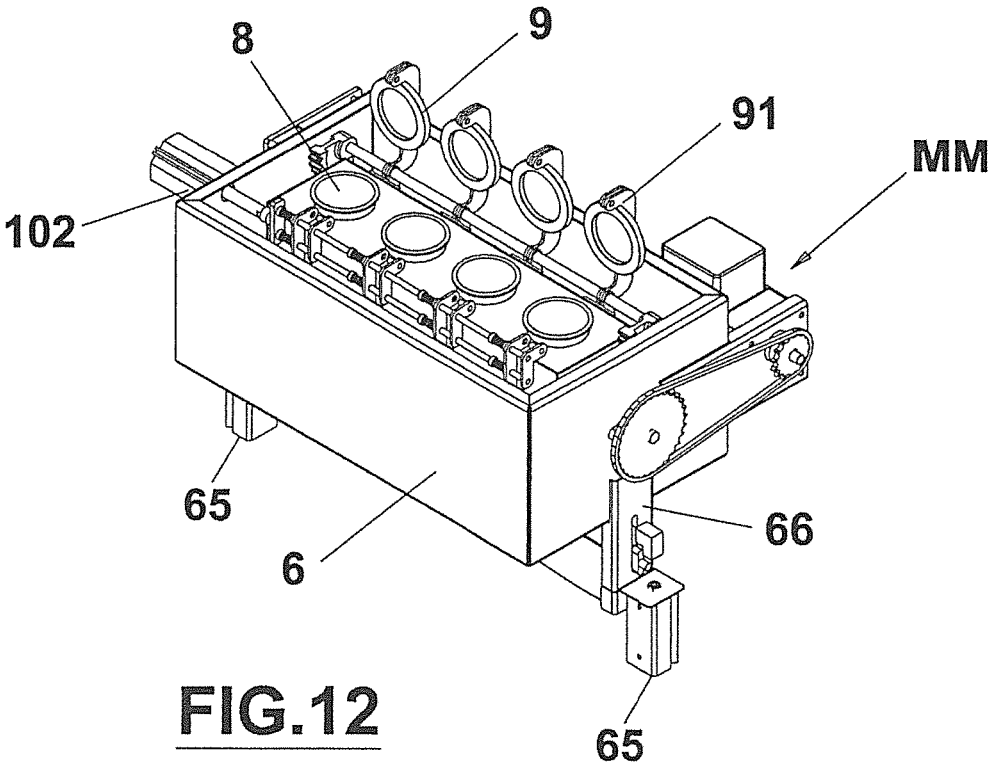
FIG. 12 is a perspective view of the machine shown in FIGS. 2-11 with the lids of the dyeing cups in the raised position.

The front arms (91) of the lids (9) can be locked to the body (7) by means of a horizontal latch (100) that is normally closed due to the action exerted by a series of springs (101). An actuator (102) with horizontal axis fixed on said side wall (62) of the fixed structure (6) is destined to act on said latch (100). When the lids (9) must be unlocked, the actuator (102) pushes the latch (100), overcoming the resistance of the springs (101), which frees the front arms (91) of the covers (9) allowing, in this way, to operate the motor (96). When the arms (91) are free, the lids (9) can be rotated by the motor (96), as previously described, to have the same lids in the closed or open position of the dyeing cups (8). In FIG. 10, the latch (100) has released the lids (9) and the springs (101) are compressed under the action of the actuator (102). In FIG. 11 the latch (100) locks the lids (9), the springs (101) are extended and the actuator (102) is inactive. In FIG. 12 the lids (9) are in the raised or open position.

Below the fixed structure (6) it is placed a discharge manifold (63) provided with upper tubular inlets (64) and able to interact with corresponding exhaust valves (80) presented below by each dyeing cup (8). The valves (80), known per se, are normally closed and are open when the tubular inlets (64) of the discharge manifold (63) are inserted in the discharge ports of the dyeing cups (8). The discharge manifold (63) is connected to a corresponding moving group with two vertical actuators (65) which allow to move it from and to the structure (6) along two vertical guides (66)

external to the structure itself. The latter has, on the respective bottom (67), holes for the passage of the tubular inlets (64) of the manifold (63) which is raised only when the body (7) is stationary with the dyeing cups in the vertical position, that is, when the dyeing cups (8) are in a position allowing the removal of the baskets (10). In FIG. 17B the manifold (63) is raised and the respective tubular inlets (64) are inserted in the discharge ports of the dyeing cups (8) to allow the discharge of the dyeing bath when the working cycle is completed.

In the body (7) are arranged means for adjusting the temperature of the thermal fluid (FT), with one or more electric resistances (R7) usable for the heating of the fluid and one or more coils (C7) in which cooling water circulates. The reference "S7" in FIG. 17A denotes a PT100 type control probe.

FIGS. 2-8 illustrate a possible operating cycle:

preliminarily, by making use of the apparatus (A), it is formed a dye bath for each of the dyeing cups (8) intended to be used;

the carriage (2) carries the gripper (5) in correspondence with a basket (10) of which is known the position on the parking zone (P10), and the gripper (5) is lowered and its "fingers" (22) are introduced into the selected basket (10);

subsequently, the "fingers" (22) of the gripper (5) are spread apart, thus engaging from the inside the upper part of the selected basket (10), and the gripper (5) is raised thus determining the raising of the same basket (10);

then, the carriage (2) carries the basket (10) in a dyeing cup (8) of the selected dyeing unit (T);

when in the chosen dyeing unit (T) has received the baskets (10) as described above, with the textile samples contained therein, the lids (9) of the dyeing unit (T) are closed and locked;

at this point, the heating phase of the thermal carrier fluid (FT) starts and the means (MM) for moving the body (7) are activated for a predetermined time;

the temperature of the thermal carrier fluid (FT) is controlled constantly or at predetermined time intervals according to the selected working program;

after said predetermined time, the movement of the body (7) is interrupted and the body (7) is positioned so as to present the lids (9) facing upwards;

then, the dyeing bath is discharged from the dyeing cups (8) and the lids (9) are unlocked and open;

subsequently, the carriage (2) carries the gripper (5) in correspondence of each of the baskets (10) to extract them from the dyeing cups (8) and reposition them at the respective starting points on the parking zone (P10) or at other predetermined points.

The use of the sealed body (7) containing the thermal carrier fluid (FT) and the fact that the dyeing cups (8) are integral with the sealed body (7), that is immovable, avoids any possible contamination of the work environment. Therefore, the selected thermal fluid may be of any type. In addition, as disclosed above, it is possible to combine the dyeing unit with an automatic apparatus for the preparation of dyeing baths, with the further advantage of increasing the automation level of the dyeing cycle.

In practice all the construction details may vary in any equivalent way as for what concerns the individual elements described and illustrated, without thereby departing from the scope of the claimed solution and, thereby, remaining within the limits of the protection granted by this patent.

The invention claim is:

1. A dyeing unit, adapted to test and/or monitor effects of dye baths on textile materials, the dyeing unit comprising:

a body with tanks with openable and closable lids, each of the tanks being configured to contain a dyeing bath and a textile sample;

a means for moving the body for stirring the dyeing bath contained in the tanks; and a means for discharging the dyeing baths from the tanks, the tanks being integrally connected to the body and the body being closed both above and laterally and interiorly to define a closed volume, the closed volume containing a thermal fluid such that the tanks are always immersed in the thermal fluid.

2. A dyeing unit according to claim 1, further comprising:

a heating and cooling means for controlling a temperature of the thermal fluid.

3. A dyeing unit according to claim 1, wherein each of the tanks is configured to contain a removable materials-holder basket.

4. A dyeing unit according to claim 3, wherein the dyeing unit is associated with an automated apparatus for preparing the dyeing baths and for handling each materials-holder basket.

5. A dyeing unit according to claim 1, further comprising:

a means for locking the lids on the body.

6. A dyeing unit according to claim 5, wherein the locking means for the lids, a means for rotating the lids and the moving means are constrained to a fixed structure.

7. A dyeing unit according to claim 1, further comprising:

a means for rotating the lids around a horizontal axis on the body.

8. A dyeing unit according to claim 7, wherein a locking means for the lids, the means for rotating the lids and the moving means are constrained to a fixed structure.

9. A dyeing unit according to claim 1, wherein the moving means comprises an electric motor configured to rotate the body around a horizontal axis alternately clockwise and counterclockwise.

10. A dyeing unit according to claim 9, wherein a locking means for the lids, a means for rotating the lids and the moving means are constrained to a fixed structure.

11. A dyeing unit according to claim 1, wherein the body is inserted in a fixed structure.

12. A dyeing unit according to claim 11, wherein a locking means for the lids, a means for rotating the lids and the moving means are constrained to the fixed structure.

13. A dyeing unit according to claim 1, wherein the dyeing unit is associated with an automated apparatus for preparing the dyeing baths and for handling removable baskets.

14. A dyeing unit, adapted to test and/or monitor effects of dye baths on textile materials, the dyeing unit comprising:

a plurality of tanks, each of the tanks comprising an openable and closable lid, each of the tanks being configured to contain a dyeing bath and a textile sample;

a closed body comprising a plurality of walls, the plurality of walls defining a closed interior space of the closed body, at least a portion of each of the plurality of tanks being arranged in the interior space of the closed body, wherein the portion of each of the plurality of the plurality of tanks is in contact with one of the plurality of walls;

a moving means for moving the body for stirring the dyeing bath contained in the tanks; and a means for discharging the dyeing baths from the tanks, the closed interior space containing a thermal fluid, the thermal fluid being in contact with each of the tanks.

15. A dyeing unit according to claim 14, further comprising:

a means for rotating each lid around a horizontal axis on the body.

16. A dyeing unit according to claim 14, wherein a locking means for each lid, a means for rotating each lid and the moving means are constrained to a fixed structure.

17. A dyeing unit according to claim 14, wherein the lid of each of the tanks is arranged at a position located outside of the closed interior space.

18. A dyeing unit, adapted to test and/or monitor effects of dye baths on textile materials, the dyeing unit comprising:

a body comprising a plurality of walls and a plurality of tanks, the plurality of walls defining a closed volume, at least a portion of the tanks being located in the closed volume, each of the plurality of tanks being integrally connected to one of the walls, each of the plurality of tanks comprising an openable and closable lid, each of the plurality of tanks being configured to contain a dyeing bath and a textile sample, the closed volume containing a thermal fluid, wherein each of the plurality of tanks is in contact with the thermal fluid;

a moving means for moving the body for stirring the dyeing bath contained in the plurality of the tanks; and a means for discharging the dyeing baths from the plurality of tanks.

19. A dyeing unit according to claim 18, further comprising:

a means for rotating each lid around a horizontal axis on the body.

20. A dyeing unit according to claim 18, wherein the lid of each of the plurality of tanks is arranged at a position located outside of the closed volume.

* * * * *